US005456412A

United States Patent [19]

Agee

[11] Patent Number: 5,456,412

[45] Date of Patent: Oct. 10, 1995

[54] HIGH PRESSURE SURFACE WASHING DEVICE

[76] Inventor: J. Christopher Agee, 4472 Shiloh Hills Dr., Lithonia, Ga. 30058

[21] Appl. No.: 852,991

[22] Filed: Mar. 16, 1992

[51] Int. Cl.[6] ..... B08B 5/04

[52] U.S. Cl. ..... 239/104; 239/258; 239/261; 239/264; 239/600; 239/722

[58] Field of Search ..... 239/251, 255, 239/261, DIG. 6, 172, 722, 600, 104, 264, 258

[56] References Cited

U.S. PATENT DOCUMENTS

| | | | |
|---|---|---|---|
| 2,683,626 | 7/1954 | Wahlin | 239/599 X |
| 2,793,911 | 5/1957 | Dudley | 239/261 X |
| 3,195,817 | 7/1965 | Sandie | 239/261 X |
| 3,312,450 | 4/1967 | Burgess | 239/261 X |
| 3,332,221 | 7/1967 | McCain | 239/DIG. 6 X |
| 3,952,955 | 4/1976 | Clements | 239/599 X |
| 4,025,045 | 5/1977 | Kubiak | 239/599 X |
| 4,191,589 | 3/1980 | Halls et al. | 239/251 X |
| 4,191,590 | 3/1980 | Sundheim | 239/251 X |
| 4,645,127 | 2/1987 | Emory et al. | 239/599 X |
| 5,104,044 | 4/1992 | Ratell | 239/259 X |

FOREIGN PATENT DOCUMENTS

| | | | |
|---|---|---|---|
| 2024611 | 1/1980 | United Kingdom | 239/261 |

*Primary Examiner*—Kevin P. Weldon
*Attorney, Agent, or Firm*—James A. Hinkle

[57] ABSTRACT

A high-pressure surface-washing device has a frame (6) with adjustable-height wheels (17), a spray nozzle (15, 16 and 74) on at least one rotary spray arm (10, 11, 63 and 64) on a rotary axle (9 and 47) positioned on a bottom surface of the frame (6), a fluid conveyance in the rotary axle, a pressure-control valve (4) on a handle (5) attached to the frame (6), a high-pressure fluid conveyance (7) in communication between the pressure control valve and the fluid conveyance (20 and 62) in the rotary axle, a source of fluid (2) under select pressure, and a high-pressure fluid conveyance (3) in communication between the source of fluid under select pressure and the pressure control valve. The spray nozzle on the rotary spray arm is directed downwardly at an impingement angle in relation to rotational axis of the rotary spray arm. The rotary spray arm is caused to rotate and to achieve rotational cleaning in a rotational direction opposite from the impingement angle as a result of reactionary and ground effects of fluid escaping under pressure from the spray nozzle.

8 Claims, 4 Drawing Sheets

HIGH PRESSURE SURFACE WASHING DEVICE

BACKGROUND OF THE INVENTION

I. Field of the Invention

The present invention relates generally to the field of devices for washing cement, wood and other hard surfaces with water and an optional cleaning agent. In particular, the invention is a rotational spray nozzle on wheels for maneuverability by an individual for washing parking lots, sidewalks, patios, roofs, floors, decks, streets and other hard surfaces of various types.

II. Description of the Prior Art

Previously there have been high-pressure surface-washing devices that are hand-held and used mostly for washing walls and various vertical surfaces. None are known or believed to exist for maneuvering over large horizontal or variously slanted surfaces to wash them in a manner provided by this invention.

This invention is intended to be used in conjunction with existing means for providing fluid under pressure in a pressure hose. Typical of a means for providing fluid under pressure is a pressure means for a conventional high-pressure washer. Common among conventional high-pressure washers intended for use in conjunction with this invention is a portable pump with ceramic pistons powered by a five-horsepower gasoline engine and having an output of three gallons per minute. It also has fluidly-downstream detergent-mixing capacity, a high-pressure hose and a pressure-control system. The high-pressure control system operates in response to hand manipulation of a valve fluidly upstream from a spray nozzle at a distal end of the high-pressure hose. This invention replaces a conventional hand-held spray-washer nozzle with a rotary spray-washer nozzle on wheels for use with this or any other source of fluid under desired pressure.

SUMMARY OF THE INVENTION

In accordance with the present invention, it is contemplated that this invention will provide a surface-washing device with rotary spray-washer nozzles on wheels for use in conjunction with existing sources of fluid under adequate pressure for desired results.

Another objective of this invention is to provide a rotary spray-washer nozzle on wheels which can be made with a sufficiently large rotary-spraying capacity for cleaning large areas such as parking lots, driveways and streets.

Another objective of this invention is to provide a rotary spray-washer nozzle on wheels which can be made sufficiently light for hand-lifting on-and-off of pickup trucks and trailers for cleaning of residential and business driveways, sidewalks, patios, parking lots and such areas.

Another objective of this invention is to provide a rotary spray-washer nozzle on wheels which can be made sufficiently light for being lifted onto roofs of buildings and maneuvered safely and conveniently on various roofs.

Another objective of this invention is to provide a rotary spray-washer nozzle on wheels which can be produced at low cost.

Another object of this invention is to provide a rotary spray-washer nozzle on wheels which is operable and maneuverable conveniently by hand.

Yet another object of this invention is to provide a rotary spray-washer on wheels which is long-lasting and reliable.

This invention accomplishes the above and other objectives with a surface-washing device having a frame with wheels, a spray nozzle on at least one rotary spray arm on a rotary axle positioned on a bottom surface of the frame, a fluid conveyance in the rotary axle, a pressure-control valve on a handle attached to the frame, a high-pressure fluid conveyance in communication between the pressure control valve and the fluid conveyance in the rotary axle, a source of fluid under select pressure, and a high-pressure fluid conveyance in communication between the source of fluid under select pressure and the pressure control valve. The spray nozzle on the rotary spray arm is directed downwardly at an impingement angle in relation to rotational axis of the rotary spray arm. The rotary spray arm is caused to rotate and to achieve rotational cleaning in a rotational direction opposite from the impingement angle as a result of reactionary and ground effects of fluid escaping under pressure from the spray nozzle. A plurality of at least two rotary arms can be extended from the rotary axle with a spray nozzle on each directed in a common circumferential direction in relation to rotational travel of the rotary arms.

Other objects, advantages and capabilities of the invention will become apparent from the following description taken in conjunction with the accompanying drawings showing preferred embodiments of the invention.

DESCRIPTION OF PREFERRED EMBODIMENT

Figure 1:
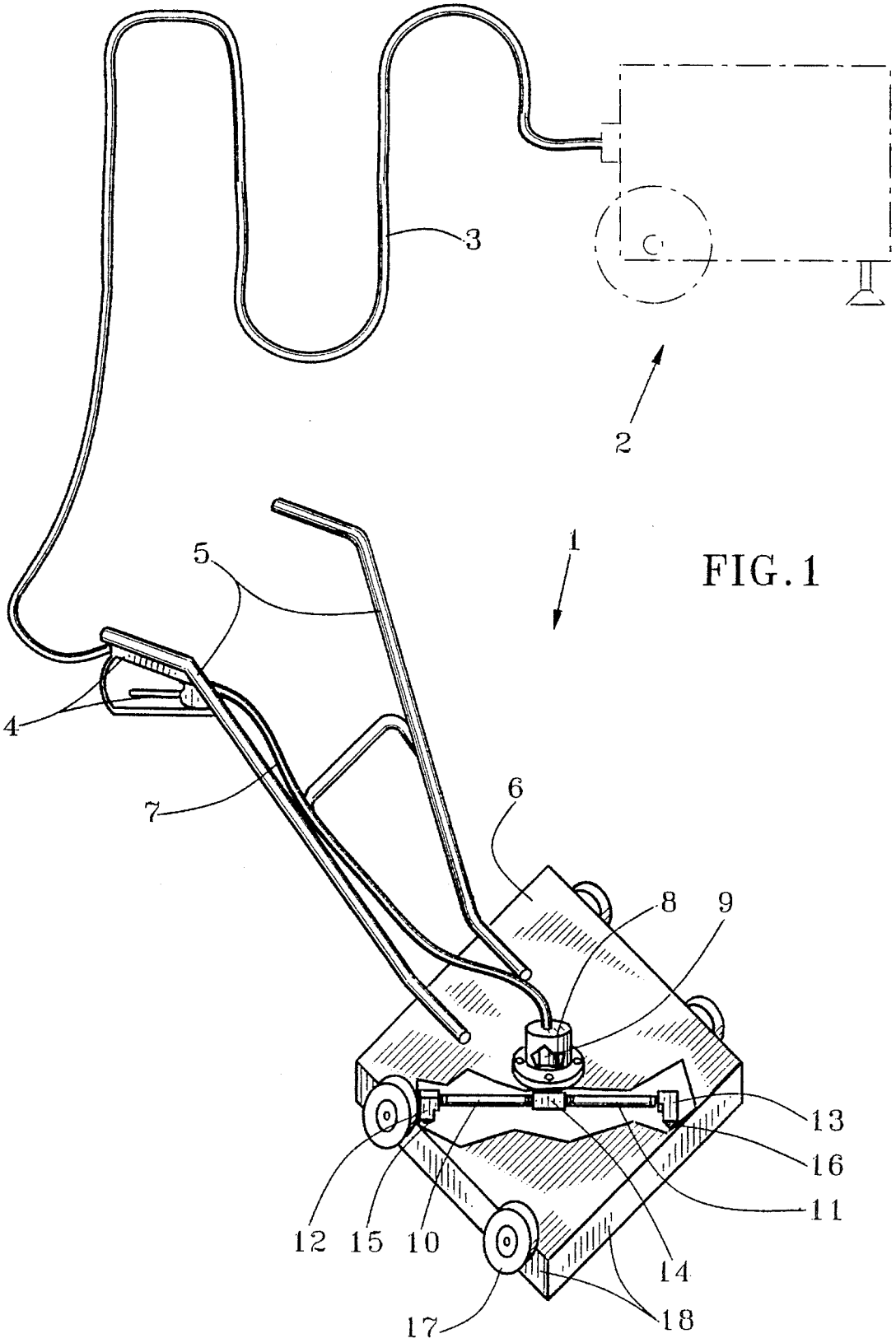
FIG. 1 is a cutaway perspective view.

Referring to the drawings wherein like reference numerals designate corresponding parts throughout the several figures, a high-pressure surface-washer 1 has a source of fluid 2 under select pressure provided through a high-pressure fluid conveyance 3 to a pressure-control valve 4 on handles 5 attached to a frame 6. From the pressure-control valve 4, pressurized fluid is directed through a handle pressure conveyance 7 to an axle housing 8 having a rotary axle 9 which conveys the fluid to oppositely-disposed rotary arms 10 and 11 with a right-angle nozzle joint 12 on rotary arm 10 and a right-angle nozzle joint 13 on rotary arm 11. The oppositely-disposed rotary arms 10 and 11 are attached to the rotary axle 9 by means of a T-joint 14. Right-angle nozzle joints 12 and 13 are slanted downwardly and in a common circumferential direction which is opposite linearly in relation to an axis of the rotary axle 9. Reactionary thrust of fluid discharged under pressure through a nozzle 15 in right-angle nozzle joint 12 and an oppositely-disposed nozzle 16 in right-angle nozzle joint 13 causes the rotary arms 10 and 11 to rotate.

Downward and rotational pressure of fluid escaping from nozzles 15 and 16 provides an effective and efficient cleaning action. Wheels 17 on corners of the frame 6 provide an exceptionally convenient and fast means for positioning the nozzles 15 and 16 on rotary arms above surfaces to be cleaned. This high-pressure surface washer is hand-propelled like a rotary push lawn mower with handles 5 but much easier because of the relatively smooth surfaces on which it is used. Also like a rotary lawn mower, the frame 6 has downwardly-projecting sides 18 to house washing action.

The source of fluid 2 under select pressure is intended to include any means for providing this function. Steam hoses used industrially and in some military applications are excellent sources 2. Water pumps and some community tap water with sufficiently high pressure are others. Most appropriate and reliable for use at any location is a conventional engine-powered high-pressure washer fluid-supply means. It was partly to utilize the capacity of conventional high-pressure washers that this invention was conceived.

Conventional high-pressure washing machines are particularly appropriate because they provide a means for mixing a cleaning agent fluidly upstream from the pressure-control valve 4. However, the action of water alone at the pressure provided by standard high-pressure washing machines is sufficient for most cleaning purposes as a result of thorough coverage of the rotary nozzles 15 and 16 in close proximity to surfaces.

Figure 2:
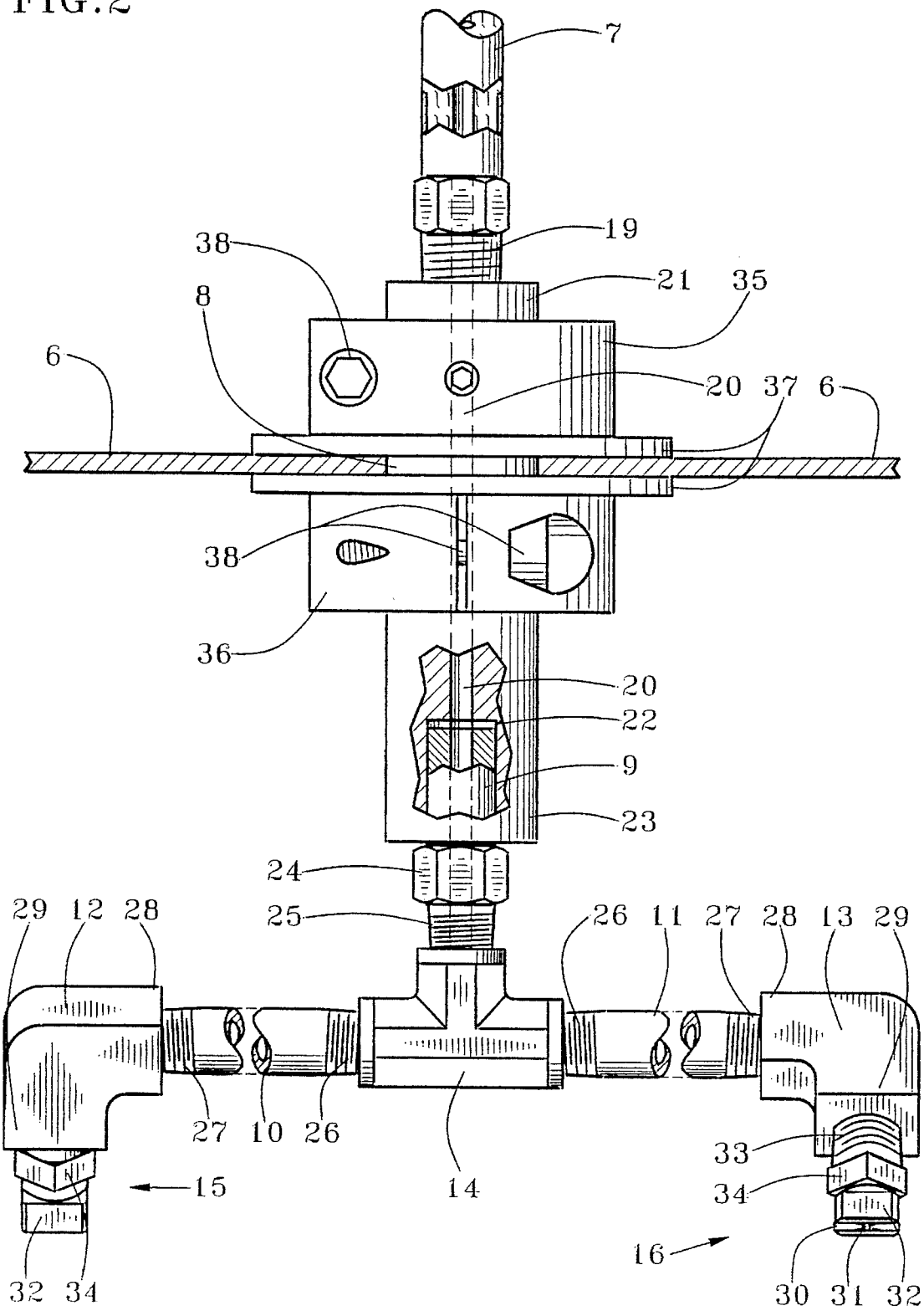
FIG. 2 is a cutaway vertical sectional view of a rotational washing portion of the invention using conventional fasteners, connectors and joints particularly appropriate for low-volume production.

Reference is made now to FIG. 2 for further detail of an embodiment of the rotary section of this invention. The handle pressure conveyance 7 can be a conventional high-pressure hose similar to or the same as high-pressure fluid conveyance 3 fluidly upstream from the pressure-control valve 4. Typically such hoses are firmly attached to an outside-diameter pipe-thread connector 19 such that threading rotation requires first counter-rotationally winding the fluid conveyance 7, which usually is made of flexible braided material, and then threading the connector 19 into a threaded receptacle in the axle housing 8 while the conveyance 7 is being unwound to its normal condition. An inside-diameter pipe-thread connector or other type of connector also can be employed. Whatever connector 19 employed is attached to axle housing 8 which has a housing conveyance 20 in communication between a housing proximal end 21 and rotary axle 9 in a major inside diameter 22 of the axle housing 8 proximate a distal end 23 of the axle housing 8. A variety of means can be employed for retaining the rotary axle 9 in the major inside diameter 22 of the axle housing 8 while it is rotated.

The rotary axle 9 is provided with wrench flats 24, preferably in the form of an axle hex, and threading, preferably in the form of tapered or pipe-thread axle joint 25. Tapered threading, also referred to alternatively as pipe thread, is preferable for two main reasons. It provides effective pressure sealing of the connection and simultaneously centers T-joint 14 concentrically to the rotary axle 9. However, high-level accuracy and, therefore, high cost of the threading of both the T-joint 14 and the pipe-thread axle joint 25 are required to prevent vibration from off-center conditions.

The rotary arms 10 and 11 can be provided with proximal-end pipe threads 26 which are threadable into T-joint 14 and distal-end pipe threads 27 which are threadable into right-angle nozzle joint 12 and right-angle nozzle joint 13 on rotary arms 10 and 11 respectively. The distal-end pipe threads 27 are threadable into right-angle nozzle-joint proximal ends 28 of the respective right-angle nozzle joints 12 and 13. Nozzles 15 and 16 are threadable into right-angle nozzle-joint distal ends 29 of the respective right-angle nozzle joints 12 and 13.

Right-angle nozzle joints 12 and 13 are positioned circumferentially with axes of distal ends 29 at desired angles in relation to an axis of rotary axle 9. These angles can be different from each other and different for different types of cleaning effects. However, both can not be positioned in opposite rotational directions. The net effect of rotational positioning of the axes of distal ends 29 must be to cause rotation of rotary arms 10 and 11 in a direction of rotation which threads T-joint 14 onto, rather than unthreads T-joint 14 off of pipe-thread axle joint 25. To achieve this effect, one of the right-angle nozzle joints 12 or 13 can be positioned circumferentially with axis of its distal end 29 parallel to or slightly off to either side of parallel to the axis of rotary axle 9, provided the axis of the distal end 29 of the oppositely-disposed right-angle nozzle joint 12 or 13 is angled sufficiently to achieve desired rotation in the direction of threading T-joint 14 onto pipe-thread axle joint 25. Typically, both right-angle nozzle joints 12 and 13 are positioned in substantially the same angle in relation to axis of the rotary axle 9. However, it may be desirable to provide for relatively direct impingement of fluid from one nozzle 15 or 16 and slanted impingement of the other for some types of cleaning action.

Nozzles 15 and 16 can be provided with fluid guides 30, usually in the form of channels, at sides of nozzle orifices 31 to direct fluid parallel to rotary arms 10 and 11. Nozzle flats 32 indicate circumferential positioning of the fluid guides 30. The nozzles 15 and 16 can be provided with nozzle pipe threads 33 and nozzle wrench flats 34 for pipe-threading them into right-angle nozzle-joint distal ends 29.

The axle housing 8 can be attached to a deck of frame 6 with a top housing ring 35 at a top surface of a deck of frame 6 and a bottom housing ring 36 at a bottom surface of a deck of frame 6. Resilient buffer rings 37 can be positioned between the frame 6 and the rings 35 and 36. The top and bottom housing rings 35 and 36 respectively can be a type of C-ring closeable with a socket-head bolt 38 in walls of the rings 35 and 36.

One advantage of this C-ring attachment means is that it is adjustable in height of nozzles 15 and 16 independently of adjustment of wheels 17 in relation to the deck of frame 6. Another advantage is that it is available as a shelf item on the market for immediate construction of this invention.

Figures 3, 4:
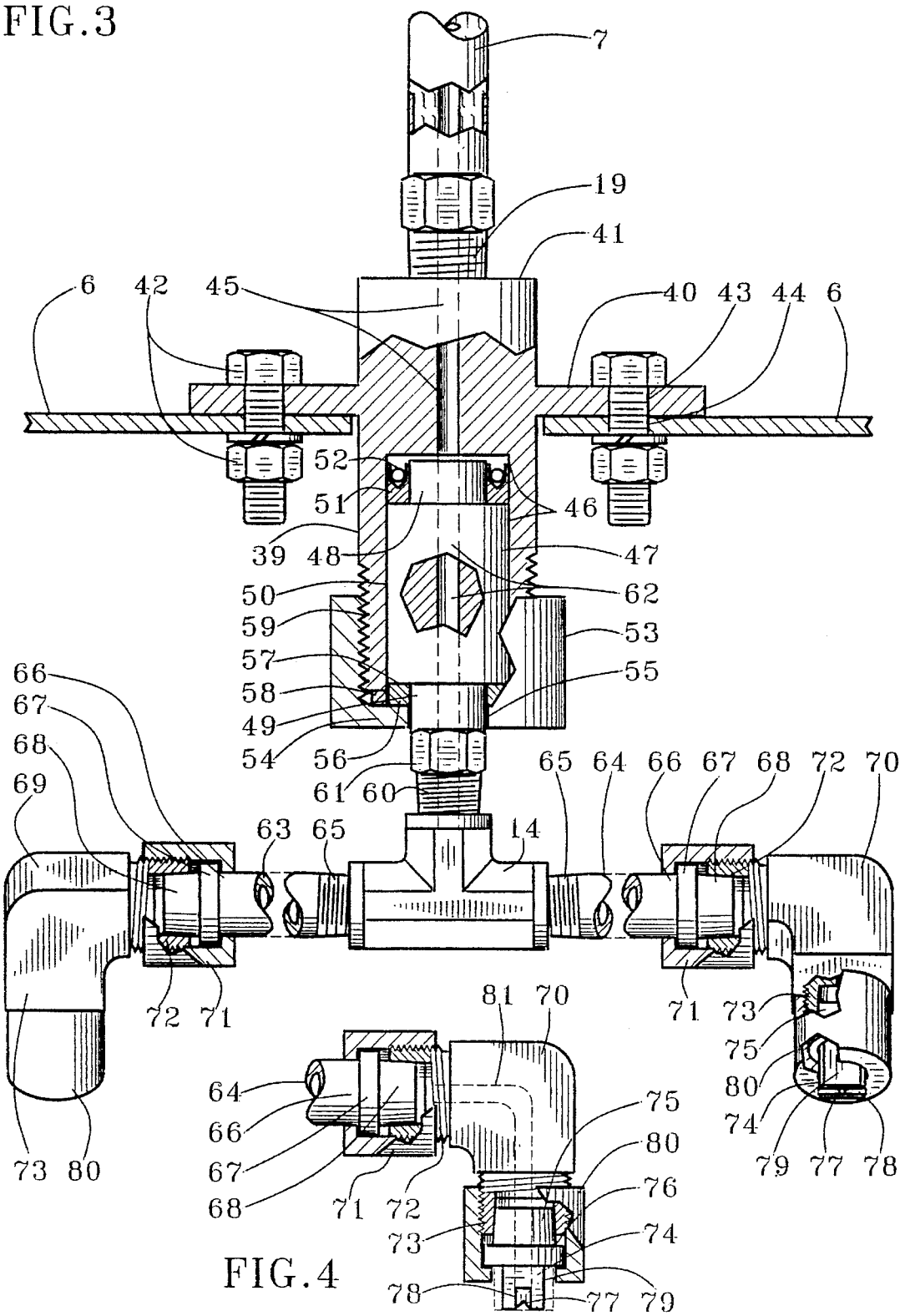
FIG. 3 is a cutaway vertical sectional view of the rotational washing portion of the invention using some conventional and some special fasteners, connectors and components for efficient large-volume production.
FIG. 4 is a cutaway sectional view of a means for positioning a nozzle appropriately in relation to a rotary washing arm.

Referring to FIG. 3, a flanged axle housing 39 with a flange 40 at a proximal end 41 of the flanged axle housing 39 can be attached to a deck of frame 6 with fastener bolts and nuts 42 positioned in flange fastener orifices 43 and deck fastener orifices 44 respectively. The pipe-thread connector 19 on the handle pressure conveyance 7 can be attached to the proximal end 41 of the flanged axle housing 39 the same as for attachment to proximal end 21 of axle housing 8 in FIG. 2.

A flanged-axle-housing fluid conveyance 45 conveys fluid from the proximal end 41 of the flanged axle housing 39 to a major inside-diameter housing orifice 46. A stepped rotary axle 47 is provided with a proximal-end minor diameter 48, a distal-end minor diameter 49 and a major diameter 50. A pressure ring, preferably in the form of a plastic V-ring 51 with coil-spring inserts 52 is positioned between the major inside diameter 46 of the housing orifice and the proximal-end minor diameter 48 of stepped rotary axle 47. The major diameter 50 of the stepped rotary axle 47 is positioned in rotary contact with an inside periphery of the major-inside-diameter housing orifice 46 of flanged axle housing 39.

The stepped rotary axle 47 is retained in position linearly by axle sleeve coupling 53 which has a coupling head 54 with an axle orifice 55. The coupling head 54 buttresses against thrust bearing 56 which buttresses against major diameter step 57 at a juncture with distal-end minor diameter 49. A lock washer 58 can be employed to prevent loosening of the axle sleeve coupling 53 which is fastened to flanged axle housing 39 with housing threads 59. The axle orifice 55 in the coupling head 54 must be large enough in diameter to allow passage of axle thread 60 and wrench flats 61 at the distal end of distal-end minor diameter 49 of the stepped rotary axle 47. A stepped-axle conveyance orifice 62 conveys fluid from flanged-housing fluid conveyance 45 to a distal end of the stepped rotary axle 47. The T-joint 14 is then screwed onto axle thread 60.

Optional to the remaining portions being the same as described in relation to FIGS. 1 and 2, shoulder-type rotary arm 63 and oppositely-disposed shoulder-type rotary arm 64 can be employed with a different embodiment of the nozzle section. Proximal ends 65 of shoulder-type rotary arms 63 and 64 can be pipe-threaded into T-joint 14 the same as for rotary arms 10 and 11. Distal ends 66 of shoulder-type rotary arms 63 and 64, however, can be provided with a shoulder 67 and a tapered point 68. Externally-threaded L-joint 69 is attachable to distal end 68 of rotary arm 63 and oppositely-disposed externally-threaded L-joint 70 is attachable to distal end 68 of rotary arm 64. This attachment is achieved by positioning a rotary-arm sleeve coupling 71 on each rotary arm 63 and 64 before attachment of proximal ends 65 to T-joint 14. The tapered points 68 are then positioned in an internally-coned proximal end 72 of each L-joint 69 and 70. The threads on the externally-threaded L-joints 69 and 70 and the threads on the threaded rotary-arm sleeve coupling 71 are straight rather than tapered threads. The straight threads of the L-joints 69 and 70 and the couplings 71 are then engaged and the couplings 71 tightened against shoulders 67. An internally-coned distal end 73 of each L-joint is the same as the proximal end 72. The L-joints 69 and 70 are reversible from one rotary arm 63 or 64 to another and from end-to-end on the ends of the rotary arms 63 and 64. The proximal end of an L-joint is whichever end is positioned on a rotary arm and the distal end is whichever end to which a coned nozzle 74 is attached.

Referring to FIGS. 3 and 4, the coned nozzle 74 is attached the same as the distal ends 66 of the rotary arms 63 and 64. Each coned nozzle 74 has a nozzle cone 75 which is substantially the same as the tapered points 68 on the rotary arms 63 and 64. Each coned nozzle 74 also has a cone shoulder 76 that is the same as the shoulder 67. The main difference is that instead of a rotary arm 63 or 64 in the form of a pipe, the nozzle 74 has a nozzle orifice 77. At each side of the nozzle cone 75 are fluid guides 78, typically in the form of channels, which direct fluid in a relatively flat spray pattern. Nozzle flats 79 indicate circumferential positioning of the fluid guides 78 and provide a means for holding the coned nozzle 74 in a desired position circumferentially while a nozzle sleeve coupling 80 is being threaded onto the distal end 73 of the L-joint. The sleeve coupling 80 can be the same as the rotary-arm sleeve coupling 71. An L-joint conveyance 81 conveys fluid between the proximal ends 72 and distal ends 73 of the L-joints.

The FIG. 3 and 4 embodiments of a rotational section of this invention are for volume production. For constructing just a few units, it is less expensive to use shelf-item connectors such as described in relation to FIGS. 1 and 2. For construction of more than five or ten units, however, it is less expensive and far more reliable to make or to have made the flanged axle housing 39, stepped rotary axle 47, rotary arms 63 and 64, L-joints 69 and 70, sleeve couplings 53, sleeve couplings 71 and 80, and coned nozzles 74. Shelf items include the V-ring 51, T-joint 14 and possibly L-joints 69 and 70.

Although the shelf-item components for the FIG. 1 and 2 embodiment are less expensive on a low volume basis, they are more expensive for high-volume production. Most important, however, the cost of assembling pipe threads in a manner that the nozzles point in the right direction and the channels in the nozzles are parallel to the rotary arms and still not have leaks is very high. There is not the versatility of directionality for effective impingement angles of fluid with the exclusive use of pipe-threaded shelf items. More labor cost can be spent achieving desired directionality without leaks with pipe threads than the cost of producing the special components for volume production.

Figure 5:
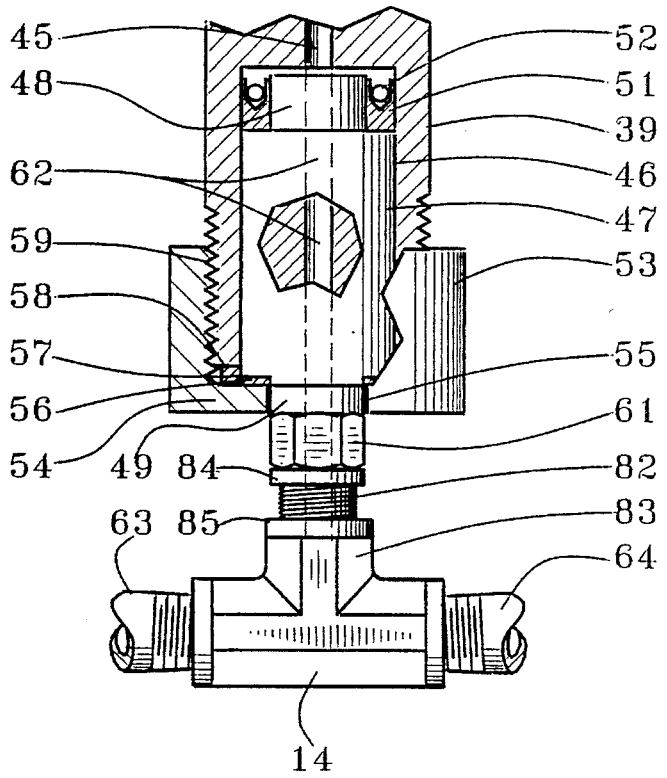
FIG. 5 is a cutaway vertical sectional view of an optional rotational assembly for large-volume production.

Referring now to FIG. 5, the thrust bearing 56 can be an integral part of either major-diameter step 57 or coupling head 54. Alternatively, materials for construction of either or both can provide suitable rotary bearing surface. Coating of either non-lubricated hard bearing material or non-lubricated soft bearing material can be provided on either or both surfaces of the coupling head 54 and the major-diameter step 57.

Another alternative construction for volume production is use of straight threads 82 for the distal-end minor diameter 49 and for leg 83 of T-joint 14. With this construction, an axle shoulder 84 and a T-leg shoulder 85 can be positioned in contact by full-length threading. It is less expensive to provide concentricity of axes of the stepped rotary axle 47 and the T-joint 14 with accurately machined surfaces of shoulders 84 and 85 than to machine and position pipe threading accurately.

Figure 6:
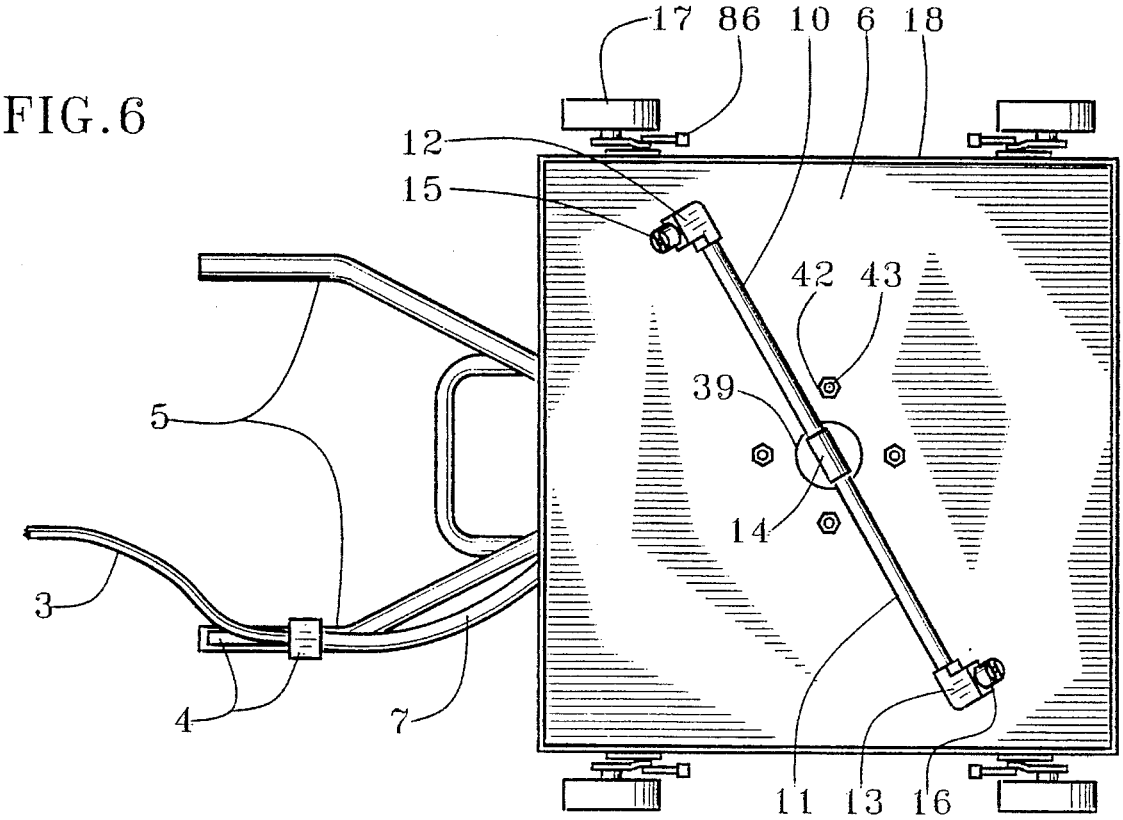
FIG. 6 is a bottom view of the FIG. 1 illustration.

Referring to FIG. 6, conventional lawn-mower wheels 17 can be provided with standard height-adjustment lever means 86. In this bottom view, the working relationship of parts of this invention are made apparent as in FIG. 1. The nozzles 15 and 16 can be seen to point in a common circumferential direction which causes clockwise rotation of the rotary arms 10 and 11. The same rotational direction causes T-joint 14 to turn in a direction which tends to thread it further onto a rotary axle threading 25 shown in FIG. 2.

Various modifications may be made of the invention without departing from the scope thereof and it is desired, therefore, that only such limitations shall be placed thereon as are imposed by the prior art and which are set forth in the appended claims.

What is claimed is:

1. A high-pressure surface-washing device having:

a frame with wheels, a handle attached to the frame, wherein the frame is rectangular with downwardly-projecting side walls and a wheel positioned in each corner of the frame, a lever means in axle-height-adjustment relationship of each wheel to the frame, a spray nozzle on at least one rotary spray arm on a rotary axle positioned on a bottom surface of the frame, the spray nozzle being directed downward and at a select angle in relation to rotational axis of the rotary axle, an axle housing inside of which the rotary axle is rotationally positioned linearly to the axle housing, a fluid conveyance means in the rotary axle, a source of fluid tinder select pressure, a high-pressure fluid conveyance means in communication between the source of fluid under select pressure and the rotary axle, a pressure-control valve in the high-pressure fluid conveyance means, said pressure-control valve being positioned on the handle which is attached to the frame, a pipe-thread means for attachment of a pressure hose to a top end of the axle housing at a position above a top surface of the frame, a means for attachment of at least one rotary arm to the rotary axle at a position below a bottom end of the rotary axle and below a bottom surface of the frame, a right-angle pipe-thread joint extended horizontally from the rotary arm, the rotary arm having a proximal end pipe-threadable onto the right-angle pipe-thread joint, a right-angle pipe-thread nozzle joint pipe-threadable onto a distal end of the rotary arm, a nozzle pipe-threadable onto the right-angle pipe-thread nozzle joint with a nozzle outlet orifice selectively positioned to project in a predetermined direction to the rotational travel of the rotary arm, nozzle-orifice guides in the nozzle positioned selectively in relation to linear axis of the rotary arm, and a means for attachment of the axle housing to the frame.

2. A high-pressure surface-washing device as claimed in claim 1, and further comprising:

an axle housing inside of which the rotary axle is rotationally positioned linearly to the axle housing, a pipe-thread means for attachment of a pressure hose to a top end of the axle housing at a position above a top surface of the frame, a means for attachment of two oppositely disposed rotary arms to the rotary axle at a position below a bottom end of the rotary axle and below a bottom surface of the frame, and a means for attachment of the axle housing to the frame.

3. A high-pressure surface-washing device as claimed in claim 2, wherein the means for attachment of the oppositely-disposed rotary arms to the rotary axle is a pipe-thread joint on the rotary axle and a pipe-thread T-joint with matching pipe thread on a leg of the pipe-thread T-joint and pipe-thread arms extendable horizontally in opposite directions from the leg of the pipe-thread T-joint, a rotary arm having a proximal end pipe-threadable onto each pipe-thread arm of the pipe-thread T-joint, a right-angle pipe-thread nozzle joint pipe-threadable onto a distal end of each rotary arm, a nozzle pipe-threadable onto each right-angle pipe-thread nozzle joint, and a nozzle outlet orifice in each nozzle having a nozzle axis directional selectively circumferential in relation to rotational travel of the oppositely-disposed rotary arms.

4. A high-pressure surface-washing device as claimed in claim 2, wherein the means for attachment of the oppositely-disposed rotary arms to the rotary axle is a pipe-thread joint on the rotary axle, a pipe-thread T-joint with matching pipe thread on a leg of the pipe-thread T-joint and pipe-thread arms extendable horizontally in opposite directions from the leg of the pipe-thread T-joint, a rotary arm with a proximal end pipe-threadable onto each pipe-thread arm of the pipe-thread T-joint, a right-angle nozzle joint having internally-coned and externally-threaded right-angle ends with an internally-coned right-angle proximal end positioned on an externally-coned distal end of each rotary arm, a rotary-arm shoulder proximate a base of each externally-coned distal end of each rotary arm, an internally-threaded coupling sleeve having an orifice in a head with the head positioned snugly against a proximal end of each rotary-arm shoulder proximate the base of each externally-coned distal end of each rotary arm by means of threading the internally-threaded coupling sleeve onto matching external threads of a proximal end of each right-angle nozzle joint, the externally-coned distal end of each rotary arm being positioned in the proximal end of each internally-coned right-angle end of each right-angle nozzle joint at a rotational position of the right-angle nozzle joint in which an axis of a distal end of each right-angle nozzle joint is at a select acute angle in relation to axis of the rotary axle such that reactionary force of fluid escaping under pressure from a nozzle with an axis concentric to an axis of the distal end of each right-angle nozzle joint causes the rotary arms to rotate in a direction which imparts rotary threading motion of the pipe-thread T-joint onto the pipe-thread joint on the rotary axle, and an internally-threaded coupling sleeve having an orifice in a head with the head positioned against a nozzle shoulder on a distal end of a nozzle having an externally-coned proximal end fittable into an internally-coned distal end of the right-angle nozzle joint on the distal end of each rotary arm by means of threading the internally-threaded coupling sleeve onto matching external threads on the distal end of each right-angle nozzle joint such that nozzle guides in distal ends of each nozzle are positioned circumferentially in relation to each rotary arm independently of threading rotation of the internally-threaded coupling sleeve onto the distal end of each right-angle nozzle joint.

5. A high-pressure surface-washing device as claimed in claim 1, and further comprising:

an axle housing inside of which the rotary axle is rotationally positioned linearly to the axle housing, the axle housing having a proximal area of major diameter and a distal area of major diameter, a pipe-thread means for attachment of a pressure hose to a top end of the axle housing at a position above a top surface of the frame, a means for attachment of two oppositely-disposed rotary arms to the rotary axle at a position below a distal bottom end of the rotary axle and below a bottom surface of the frame, a frame-attachment flange on the axle housing, fastener orifices in the frame-attachment flange, fastener orifices in the frame sized, shaped and positioned to match the fastener orifices in the frame-attachment flange, a major diameter of the rotary axle in rotational contact with an inside periphery of a major inside diameter of the axle housing, a proximal-end minor diameter of the rotary axle positioned in a proximal end of the major inside diameter of the axle housing, a distal-end minor diameter of the rotary axle positioned to extend beyond the major distal diameter of the axle housing, a rotary-axle coupling sleeve having a head with a shaft orifice through which the distal-end minor diameter of the rotary shaft is extended, a compression ring positioned circumferentially between an inside periphery of a proximal end of the major inside diameter of the axle housing and an outside periphery of the proximal-end minor diameter of the rotary axle, a thrust bearing positioned between a distal end of the major diameter of the rotary axle and an inside periphery of the head of the rotary-axle coupling sleeve, outside-diameter threads on the distal end of the axle housing, and inside-diameter threads on the rotary-axle coupling sleeve which match the outside-diameter threads on the distal end of the axle housing.

6. A high-pressure surface-washing device as claimed in claim 5, wherein the compression ring is a V-ring.

7. A high-pressure surface-washing device as claimed in claim 5, wherein the thrust bearing is an integral part of the rotary-axle coupling sleeve.

8. A high-pressure surface-washing device as claimed in claim 5, wherein the thrust bearing is an integral part of the rotary axle.

* * * * *